United States Patent [19]

Yamamoto

[11] Patent Number: 4,962,811

[45] Date of Patent: Oct. 16, 1990

[54] HEAT EXCHANGER

[75] Inventor: Yuji Yamamoto, Tochigi, Japan

[73] Assignee: Showa Aluminum Corporation, Sakai, Japan

[21] Appl. No.: 422,482

[22] Filed: Oct. 17, 1989

[30] Foreign Application Priority Data

Oct. 18, 1988 [JP] Japan ..... 63-135926[U]

[51] Int. Cl.[5] ..... F28F 9/02

[52] U.S. Cl. ..... 165/173; 165/150; 165/153

[58] Field of Search ..... 165/150, 153, 173, 174; 126/445, 448; 62/525

[56] References Cited

U.S. PATENT DOCUMENTS 2,878,651 3/1959 Heinzelman ..... 62/235
2,894,381 7/1959 Palmatier ..... 62/515
4,178,914 12/1979 Erb ..... 126/449
4,353,355 10/1982 Stewart ..... 126/445
4,620,590 11/1986 Koisuka et al. ..... 165/150

*Primary Examiner*—Martin P. Schwadron
*Assistant Examiner*—Allen J. Flanigan
*Attorney, Agent, or Firm*—Armstrong, Nikaido, Marmelstein, Kubovcik & Murray

[57] ABSTRACT

A heat exchanger has a tubular inlet header and a tubular outlet header, each formed in its peripheral wall with a slot extending axially thereof, and a zigzag tube comprising a plurality of straight tube portions arranged in parallel to one another and bent portions each interconnecting the immediately adjacent straight tube portions at their upper or lower ends. The tube portions at opposite ends of the flat tube are joined to the respective headers with the unconnected end of each tube portion inserted in the slot. An extension of the center line of the flat tube portion inserted in the outlet header does not intersect the center line of the outlet header.

2 Claims, 3 Drawing Sheets

HEAT EXCHANGER

BACKGROUND OF THE INVENTION

The present invention relates to heat exchangers, for example, for use in evaporators for motor vehicle air conditioners.

The terms "upper," "lower," "right" and "left" as used herein each refer to the corresponding side of FIG. 1 and FIGS. 3 to 6. Further the term "aluminum" as used herein includes pure aluminum and aluminum alloys.

PRIOR ART

Conventional heat exchangers for use in evaporators for motor vehicles include those which comprise a tubular inlet header and a tubular outlet header each formed in its peripheral wall with a slot extending axially thereof, and a zigzag flat tube comprising a plurality of straight tube portions arranged in parallel to one another and bent portions each interconnecting the immediately adjacent straight tube portions at their ends. The straight tube portions at opposite ends of the flat tube are joined to the respective headers, with the unconnected end of each straight tube portion inserted in the slot. With reference to FIGS. 6*a*, 6*b* showing such a heat exchanger, the peripheral wall 13*a* of an outlet header 13 is formed with a slot 31 vertically extending through the wall 13*a* and positioned on a line where the wall 13*a* intersects a vertical plane containing the center line 0 of the header 13. A straight tube portion 10*a* of a zigzag flat tube 10 at one end thereof has its lower end inserted in the slot 31 and joined to the outlet header 13 so as to be present in the plane containing the center line 0 of the header 13. An extension of the center line X3 of the inserted portion of the flat tube 10 intersects the center line 0 of the header 13. Throughout FIGS. 6*a*, 6*b* and the other drawings showing the embodiments to be described, like parts are designated by like reference numerals.

However, the conventional evaporator for motor vehicle air conditioners has the problem that the refrigerant produces a noise when flowing into the outlet header 13 from the flat tube 10. The reason will presumably be as follows although still remaining to be fully clarified. With reference to FIG. 6*a*, jets of refrigerant flow into the outlet header 13 as indicated by arrows A. When the refrigerant flows into the header 13 in the form of jets indicated by arrows A, there occurs in the interior of the header 13 at the left side of FIG. 6*a* a portion P1 where the refrigerant fails to spread and in which a vacuum is produced. The pressure difference between the vacuum portion P1 and the opposite portion toward which the jets flow changes the direction of the jets as indicated by arrows B in FIG. 6*b*. The change of direction then produces a refrigerant-free vacuum portion P2 in the interior of the outlet header 13 at the right side of FIG. 6*b*. The resulting pressure difference between the vacuum portion P2 and the other portion where the jets flow changes the direction of jets again as indicated by arrows A. Such changes occur repeatedly in succession to produce pressure waves which release a noise. The evaporator for motor vehicle air conditioners is disposed on the interior side of the vehicle, so that the noise thus produced has been a great obstacle in improving the quietness of the interior.

SUMMARY OF THE INVENTION

The main object of the present invention is to provide a heat exchanger free of the foregoing problem.

The present invention provides a heat exchanger having a tubular inlet header and a tubular outlet header each formed in its peripheral wall with a slot extending axially thereof, and a zigzag flat tube comprising a plurality of straight tube portions arranged in parallel to one another and bent portions each interconnecting the immediately adjacent straight tube portions at their ends, the straight tube portions at opposite ends of the flat tube being joined to the respective headers with the unconnected end of each, straight tube portion inserted in the slot. The heat exchanger is characterized in that an extension of the center line of the flat tube portion inserted in the outlet header does not intersect the center line of the outlet header. The feature described eliminates the interior portion of the outlet header where the refrigerant fails to spread when flowing into the outlet header, consequently precluding the changes in the direction of jets of the refrigerant that would otherwise occur and preventing the noise.

The invention will be described in greater detail with reference to FIGS. 1 to 5.

DESCRIPTION OF THE PREFERRED EMBODIMENTS

Figure 1:
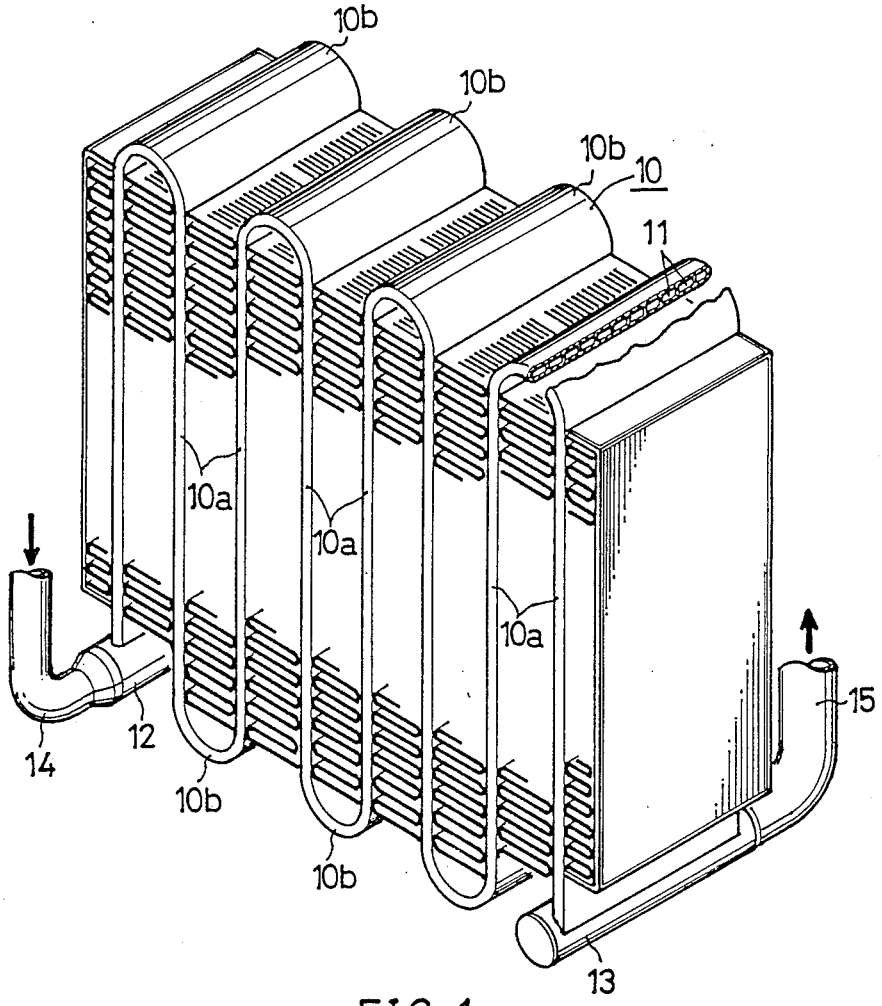
FIG. 1 is an overall perspective view partly broken away and showing a heat exchanger as a first embodiment of the invention.

Throughout the drawings, like parts are designated by like reference numerals and will not be described repeatedly.

Figure 2:
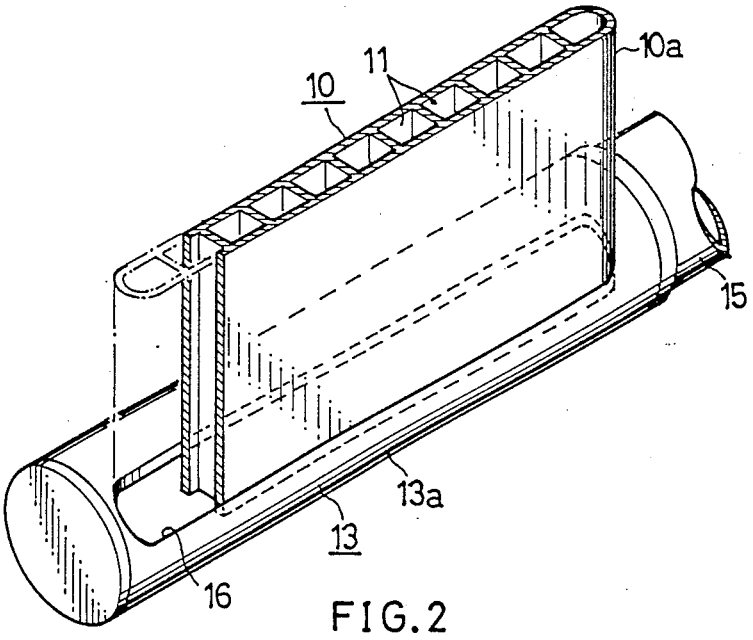
FIG. 2 is an enlarged perspective view partly broken away and showing the outlet header portion of the heat exchanger.
Figure 3:
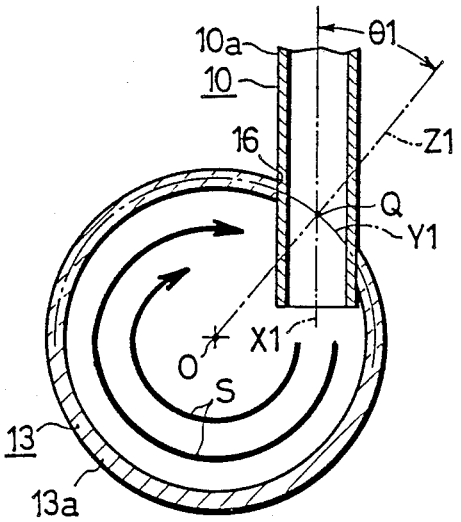
FIG. 3 is a view in cross section of the outlet header portion.

With reference to FIGS. 1 to 3 showing a heat exchanger as a first embodiment of the invention, the heat exchanger comprises a zigzag flat aluminum tube 10 having a plurality of refrigerant channels 11 in its interior, an inlet header 12 and an outlet header 13 joined to the respective ends of the flat tube 10 and each in the form of a pipe with a circular cross section, a refrigerant inlet pipe 14 connected to one end of the inlet header 12, and a refrigerant outlet pipe 15 connected to one end of the outlet header 13. The zigzag flat tube 10 comprises a plurality of straight tube portions 10*a* arranged in parallel to one another, and bent portions 10*b* each interconnecting the immediately adjacent tube portions 10*a* at their upper or lower ends. The straight tube portions 10*a*, 10*a* at opposite ends of the tube 10 have their lower ends joined to the respective headers 12; 13.

The peripheral wall 13*a* of the outlet header 13 has a flat tube inserting slot 16 extending vertically through the wall 13*a*, formed along the center line 0 of the header 13 and positioned on a line where the peripheral wall 13*a* intersects a plane present at the right side of and in parallel to a vertical plane containing the center line 0. The straight tube portion 10*a* at one end of the falt tube 10 is present in the above plane parallel to the vertical plane containing the header center line 0 and has its lower end inserted in the slot 16 and joined to the outlet header 13, with the opening of the lower end directed vertically downward. Accordingly, an extension of the center line X1 of the part of the tube portion 10*a* inserted in the outlet header 13 does not intersect the center line 0 of the header 13. Further at a point Q shown in FIG. 3, the center line X1 intersects a line Y1 through the center of the thickness of the header peripheral wall 13*a*. Preferably, the center line X1 makes an angle $\theta 1$ of 10° to 90 degrees with a line Z1 through the point of intersection Q and the center line 0 of the outlet header 13.

In the structure described above, the refrigerant sent through the flat tube 10 flows into the outlet header 13 in the form of jets as indicated by arrows S in FIG. 3. In the interior of the header 13, therefore, there is no portion where the refrigerant fails to spread. This precludes the changes in the direction of jets that would otherwise occur, consequently preventing noises.

Figure 4:
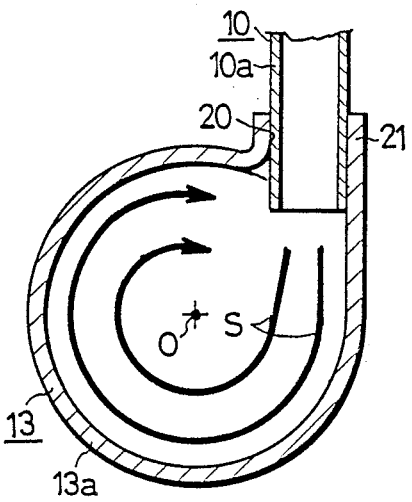
FIG. 4 is a view in cross section of an outlet header portion to illustrate a second embodiment of the invention.

FIG. 4 shows a second embodiment of the invention, in which a flat tube inserting slot 20 is positioned further rightward from the position of the slot in the first embodiment. A vertically upward flange 21 is formed on the peripheral wall 13*a* of an outlet header 13 around the slot 20 over the entire periphery thereof. The portion of the flange 21 formed along the right side edge of the slotted portion 20 is integral with the peripheral wall 13*a* of the header 13 and extends upward tangentially thereof. Accordingly, the angle $\theta$ is greater than in the case of the first embodiment. The second embodiment has the same construction as the first embodiment with the exception of the above feature and is similarly made free of noises.

Figure 5:
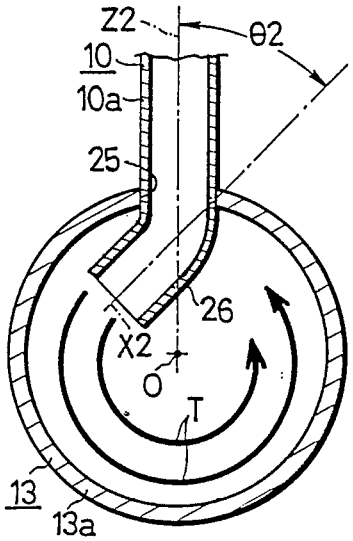
FIG. 5 is a view in cross section of another outlet header portion to illustrate a third embodiment of the invention.
Figure 6A:
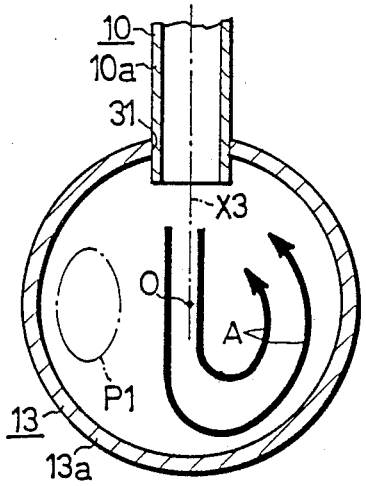
FIG.6a PRIOR ART
FIGS. 6*a* and 6*b* are views in cross section showing the outlet header portion of a conventional heat exchanger.
Figure 6B:
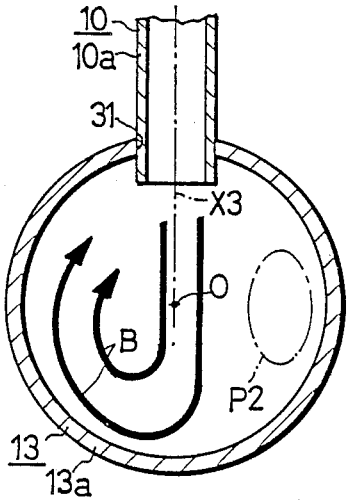
FIG.6b PRIOR ART

With reference to FIG. 5 showing a third embodiment of the invention, a flat tube inserting slot 25 extending vertically through the peripheral wall 13*a* of an outlet header 13 is formed immediately above the center line 0 of the header 13, i.e., at the position where the peripheral wall 13*a* intersects a vertical plane containing the center line 0. The straight tube portion 10*a* of the flat tube 10 at one end thereof is present in the vertical plane containing the center line ) and has its lower end inserted in the outlet header 13 and bent obliquely leftward within the header 13. The bent part is indicated at 26. An extension of the center line X2 of the bent part 26 does not intersect the center line 0 of the outlet header 13. Preferably, a vertical line Z2 containing the center line 0 of the outlet header 13 makes an angle $\theta 2$ of 10° to 90 degrees with the center line X2 of the bent part 26.

With the structure described above, the refrigerant sent through the flat tube 10 flows into the outlet header 13 in the form of jets as indicated by arrows T in FIG. 5. In the interior of the header 13, therefore, there is no portion where the refrigerant fails to spread. This precludes the changes in the direction of jets that would otherwise occur, consequently preventing noises.

What is claimed is:

1. A heat exchanger comprising:

a tubular inlet header and a tubular outlet header, each formed in a respective peripheral wall with a slot extending axially thereof, the tubular outlet header is formed with the slot on a line where the peripheral wall thereof intersects a plane containing a center line of the outlet header; and a zigzag flat tube including a plurality of straight tube portions arranged in parallel to one another, the straight tube portion at one end of the flat tube is present in the plane containing the center line of the tubular outlet header, the straight tube portion being bent at an end thereof inserted in the tubular outlet header, and bent portions each interconnecting immediately adjacent straight tube portions at respective ends, the straight tube portions at opposite ends of the flat tube being joined to the respective headers with an unconnected end of each straight tube portion inserted in the slot, an extension of the center line of the bent portion does not intersect the center line of the tubular outlet header.

2. A heat exchanger as defined in claim 1 wherein the center line of the bent portion of the straight tube portion providing one end of the flat tube and inserted in the outlet header makes an angle of 10° to 90 degrees with a vertical line.

* * * * *